US008525026B1

(12) United States Patent
Rhea et al.

(10) Patent No.: US 8,525,026 B1
(45) **Date of Patent: *Sep. 3, 2013**

(54) EPIDERMAL FRIENDLY TWIST-ON WIRE CONNECTORS

(75) Inventors: Steven Rhea, St. Peters, MO (US); James Keeven, O'Fallon, MO (US); Frank Vlasaty, Lake St. Louis, MO (US); William Hiner, O'Fallon, MO (US); L. Herbert King, Jr., Jupiter, FL (US)

(73) Assignee: The Patent Store LLC, O'Fallon, MO (US)

( * ) Notice: Subject to any disclaimer, the term of this patent is extended or adjusted under 35 U.S.C. 154(b) by 340 days.

This patent is subject to a terminal disclaimer.

(21) Appl. No.: 12/804,412

(22) Filed: Jul. 21, 2010

Related U.S. Application Data

(63) Continuation-in-part of application No. 12/455,865, filed on Jun. 8, 2009, now Pat. No. 8,067,692, which is a continuation-in-part of application No. 11/515,465, filed on Sep. 1, 2006, now Pat. No. 7,560,645, which is a continuation-in-part of application No. 11/249,868, filed on Oct. 13, 2005, now abandoned, and a continuation-in-part of application No. 12/586,947, filed on Sep. 30, 2009.

(51) Int. Cl.
*H01R 4/22* (2006.01)

(52) U.S. Cl.
USPC ..... 174/87

(58) Field of Classification Search
USPC ..... 174/87
See application file for complete search history.

(56) References Cited

U.S. PATENT DOCUMENTS

| | | | | |
|---|---|---|---|---|
| 3,297,816 | A * | 1/1967 | Waddington | 174/87 |
| 3,519,707 | A * | 7/1970 | Krup | 264/249 |
| 5,975,939 | A * | 11/1999 | Market | 439/415 |
| 6,478,606 | B1 * | 11/2002 | McNerney et al. | 439/415 |
| 7,560,645 | B2 * | 7/2009 | King et al. | 174/87 |
| 8,067,692 | B2 * | 11/2011 | Hiner et al. | 174/87 |
| 8,212,147 | B2 * | 7/2012 | Rhea et al. | 174/87 |

* cited by examiner

*Primary Examiner* — Chau Nguyen
(74) *Attorney, Agent, or Firm* — Jacobson & Johnson LLC

(57) ABSTRACT

An epidermal friendly twist-on wire connector and a method of applying an epidermal twist-on wire connector having a resilient gripping region including a set of low profile, resilient ribs that are circumferentially spaced so that a users thumb and fingers can compressively and sequentially engage and compress at least a portion of a plurality of ribs as well as the valley between the ribs during application of a wire securement torque to the twist-on wire connector while at the same time inhibiting or preventing epidermal trauma in a users thumb and fingers.

16 Claims, 3 Drawing Sheets

EPIDERMAL FRIENDLY TWIST-ON WIRE CONNECTORS

CROSS REFERENCE TO RELATED APPLICATIONS

This application is a continuation in part of U.S. patent application Ser. No. 12/455,865 filed Jun. 8, 2009 now U.S. Pat. No. 8,067,692, which is a continuation in part of U.S. application Ser. No. 11/515,465 Filed Sep. 1, 2006 (now U.S. Pat. No. 7,560,645) which is a continuation in part of U.S. patent application Ser. No. 11/249,868 filed Oct. 13, 2005 now abandoned and U.S. Ser. No. 12/586,947 filed Sep. 30, 2009.

FIELD OF THE INVENTION

This invention relates generally to wire connectors and, more specifically, to an epidermal friendly twist-on wire connector that inhibits or prevents epidermal trauma to the users fingers and thumb.

STATEMENT REGARDING FEDERALLY SPONSORED RESEARCH OR DEVELOPMENT

None

REFERENCE TO A MICROFICHE APPENDIX

None

BACKGROUND OF THE INVENTION

The concept of twist-on wire connector with a cushioned grip is known in the art, more specifically Blaha U.S. Pat. No. 6,677,530 discloses numerous embodiments of twist-on wire connectors and points out that the cushioned grip is on a portion of the exterior hard or rigid shell with the cushioned grip being an olefinic thermoplastic vulcanizate sold under the name Santoprene®, a trademark of Advanced Elastomer system of Akron, Ohio. Blaha describes a twist-on wire connector wherein the exterior of the wire connector shell has three main areas, a closed end section, a skirt and a grip mounting portion. The grip mounting portion is the region the user engages with his or her fingers in order to twist the wire connector into engagement with an electrical wire or wires.

Blaha points out that with molds of particularly close tolerances, such as found in the Twister® wire connector a cushioned grip can be formed over the Twister® wire connector without the use of boundary edges. The twist-on wire connector with a cushioned grip on the grip mounting portion is sold by Ideal Industries Inc. under the name Twister®PRO and is shown in the web page downloaded from the Ideal Industries which is included with the 1449 material information statement of the present application.

Blaha points out the problem of installing twist-on wire connectors with a hard shell is that if numerous connections are made the hard plastic surface can be painful on the fingers or in certain instances the shell surface can be slippery due to the sweat or soil on the users hand. As a solution to the problem Blaha proposes to place a cushioned material over the hand gripping portions of the wire connector to make the wire connector more comfortable to grasp. While Blaha recognizes that the placement of cushion on the grip mounting portion of the twist-on wire connector can reduce fatigue Blaha does not recognize that not everyone grasps the twist-on wire connectors in the same manner or that because of cramped conditions it might not be possible to grasp the twist-on wire connector on the grip mounting portions to enable the user to benefit from the cushioned grip of Blaha. Consequently, while the Blaha twist-on wire connector has a cushioned grip it can be of little benefit to those users who do not grip the twist-on wire connector on the normal designated gripping portions or those users who might have to apply a twist-on wire connector in a location with inadequate space to position the users hand or fingers around the normal hand gripping regions of the twist-on wire connector. While Blaha U.S. Pat. No. 6,677,530 shows multiple embodiments of his cushioned grip in each of his embodiments he places his cushioned grip at the base or open end of his wire connector while leaving the end section of his wire connector proximate the closed end of the wire connector with the hard shell exposed. Ironically, if the twist-on wire connector is to be applied in a tight location it is the uncushioned end section which the user grasps to twist the wire connector onto the wires. Since the end section usually has a smaller radius than the base or normal finger grasping portion an increased hand or finger pressure is required to obtain necessary torque to apply the twist-on wire connector. Thus, when application conditions are the most difficult one not only does one not have the benefit of cushioned grip for the users fingers but one has to generate greater hand force on the twist-on wire connector to obtain the necessary torque to bring the wire connector into engagement with the electrical wires therein.

Krup U.S. Pat. No. 3,519,707 illustrates another type of twist-on wire connector wherein a vinyl shield with ribs is placed around an exteriors surface of rigid cage that has sufficient strength and rigidity to drive the spring onto a cluster of wires. Krup states the purpose of his vinyl shell around the rigid case is to insulate and protect the connector and the wire connector. However, Krup fails to teach that the vinyl shell located around his rigid cage comprises a cushioned surface that can reduce epidermal trauma.

McNerney U.S. Pat. No. 6,478,606 shows a twist-on wire connector with a tensionally-biased cover. McNerney fits a sleeve of heat shrinkable material over a portion of his wire connector so that after a wire connection is made the heat shrinkable material can be shrunk fit around his connector to improve the bond to his connector and around the wires in order to prevent contaminants from entering the wire splice in his wire connector. In order to have ridges for gripping McNernery points out a tube of heat shrinkable material tightly grips his hard shell so as to replicate the grooves in the hard shell of his connector. Unfortunately, tightly shrinking the material around the body of connector can introduce a circumferential bias or tension force in the heat shrunk material thus rendering material which may even be soft into a covering that is hard to the touch and is reluctant to yield to finger torque. Thus the heat shrunken tube on the body of his wire connector produces an external surface that resists resilient displacement and is also hard and is uncomfortable in response to the finger and hand pressure of the user since the tension and bias forces introduced by the heat shrinking limit the yielding of his material. That is, by stretching the material around the connector McNerney biases the material much like a spring under tension has an inherent bias. The bias introduced by the heat shrink process can prevent heat shrunk material from yielding equally in all three axis. Consequently, the heat shrinkable material in effect becomes like a stretched spring, which has increased resistance to stretching. The effect is to form an elastomer material into a hard cover or non resilient cover on a hard shell since a heat shrunk cover is limited in its ability to absorb external finger pressure. In addition any protuberances on the hard shell are carried through and become hard protuberances on the heat-shrunk layer. McNerney espouses the hardness of his heat-shrunk cover by pointing out that heat shrinking can produce a rigid case for his coil spring. In contrast to McNerney the present invention provides a cover to a twist-on wire connector that eliminates the problems generated by McNerney heat shrunk cover.

While other prior art reveals that pads, wings and ribs have been placed on the exterior of twist-on wire connectors to provide a good grip the art and that soft covers have been placed on portions of the twist-on wire connectors to cushion the grip the issue the art fails to recognize that epidermal trauma can occur even with soft covers during finger application of twist-on wire connectors because to secure the twist-on wire connector the user generates finger and thumb pressures that are in excess of those pressure that produce epidermal trauma.

SUMMARY OF THE INVENTION

A twist-on wire connector having a resilient cover that includes a resilient gripping region having a set of low profile, resilient ribs that are circumferentially spaced so that a users thumb and fingers can compressively engage and compress at least a portion of a plurality of ribs as well as the valley between the ribs with the finger and thumb pressure wherein the finger and thumb pressure on the twist-on wire connector generates a wire securement torque that is below a level that causes epidermal trauma to the users finger and thumb.

DESCRIPTION OF THE PREFERRED EMBODIMENT

Figure 1:
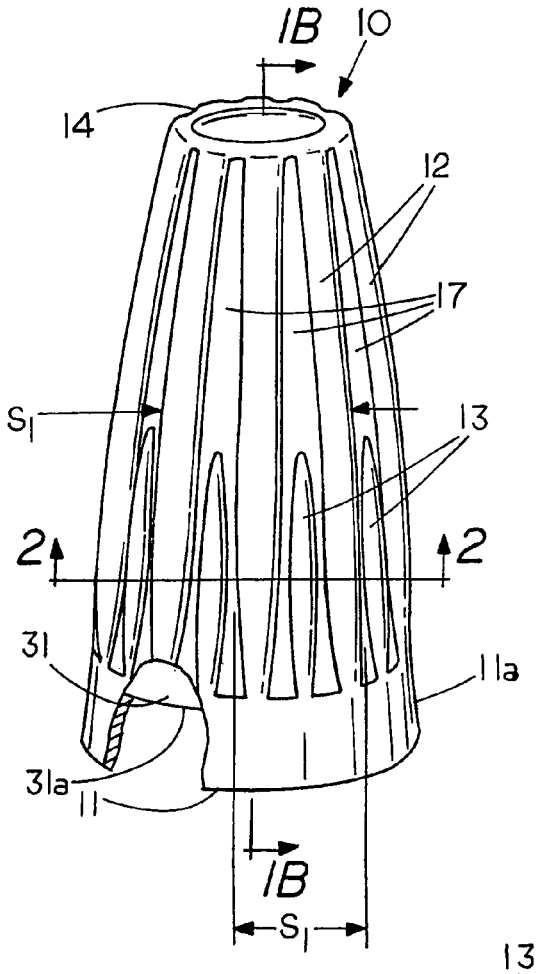
FIG. 1 is a perspective view of a comfort grip and feel twist-on wire connector.

While it is known that pads, wings and rigid ribs have been placed on the exterior surface of twist-on wire connectors to provide a good grip the art is silent on epidermal trauma to the users fingers and thumb which is caused during applications of twist-on wire connectors. An aspect of the invention described herein is that the surface features of the twist-on wire connector not only enhance a users grip thereon but the surface features of the twist-on wire connector can also inhibit or prevent epidermal trauma on those portion of the users fingers and thumb that frictionally engage the twist-on wire connector by limiting the amount of finger and thumb pressure necessary to generate a wire securement torque on the twist-on wire connector. Epidermal trauma is a condition where the epidermis layer on the users finger and thumbs becomes irritated or ruptured by application of a wire securement torque to harsh external features on the twist-on wire connector and may appear as a wound or a discoloration of the skin or both.

While the placement of a partial cushion cover on the exterior surfaces of a twist-on wire connector has been used to cushion the users grip; however, little attention has been paid to the relationship between the epidermis layer of the thumb and fingers and the features on the circumferential surface of the twist-on wire connector, particularly, during applications of twist-on wire connector. As described herein it has been found that if certain features in a resilient cover are maintained on twist-on wire connectors of a family of different size finger friendly twist-on wire connectors one is able to both comfortably grasp and secure various size twist-on wire connector and generate a wire securement torque while also inhibiting or preventing epidermal trauma to the users thumb and fingers during applications of the twist-on wire connectors.

Typically, the epidermal contact area on a users finger that radially and frictionally engages an outer surface of the twist-on wire connector is on the order of about 0.2 square inches. Similarly the epidermal contact area on a users finger that radially and frictionally engages the outer surface of the twist-on wire connector is also on the order of about 0.2 square inches. While the size of the contact areas may vary depending on the size of the users fingers and thumb as well as the size of the twist-on wire connector it is these relatively small epidermal regions on the users finger and thumb that must transfer the necessary radial and tangential forces to create a wire securement torque. Briefly a wire securement torque is a torque that is sufficient to bring the twist-on wire connector into electrical engagement with a set of electrical wires. The wire securement torque may vary with the size of the wire connector or with the size and number of the electrical wires being secured but with each twist-on wire connector and set of wires there exists a minimal wire securement torque to bring the electrical wires into electrical engagement with each other. Oftentimes the application of the wire securement torque to prior art twist-on wire connectors causes epidermal trauma on the users thumb or fingers or both since the finger pressure required to generate the wire securement torque creates high pressure points on the epidermal layer which may rupture or tear the epidermal layer as the wire securement torque is applied to the connector. It is particularly true if the exterior surface of the twist-on wire connector contains rigid protuberances. In other cases even non-rigid protuberances may cause epidermal trauma because of the relationship between the protuberances and the supporting surfaces. For example, in some cases the spacing or the radial height variation between adjoining surfaces on the twist-on wire connector may result in epidermal trauma on the users fingers and thumb during the application of the wire securement torque to the twist-on wire connector.

FIG. 1 shows a perspective view of an epidermal friendly twist-on wire connector 10 that inhibits or prevents epidermal trauma on a users thumb and fingers during application of a wire securement torque to a twist-on wire connector. Twist-on wire connector 10 includes a closed end 14 and an open end for inserting electrical wires therein. The exterior surface of wire connector 10 includes a layer of resilient material 11 including a first integral set of elongated, longitudinally extending, resilient ribs 12 and a second integral set of shorter elongated, longitudinally extending, resilient ribs 13 that are interspersed between the ribs 12. The ribs extend radially outward from a valley 17 which is formed by the resilient one-piece cover 11 which extends over the rigid but non-brittle shell 31 of connector 10 with an annular base 11*a* forming a flexible skirt on the end of the rigid shell 31. A cutaway on the bottom of twist-on wire connector 10 shows resilient cover 11 extending in an unsupported condition beyond an open end 31*a* of the open-end rigid shell 31 to form the resilient skirt 11*a* which is part of one-piece resilient cover 11.

In the example shown the ribs 12 and 13 are molded as part of a one-piece resilient cover 11 that extends over the rigid shell 31 which is centrally located in the interior of the twist-on wire connector. The resilient material 11, which may be an electrically insulating polymer plastic, that compresses in response to radial finger pressure and has sufficient tear resistance to resist separating from the connector as tangential forces are applied to the twist-on wire connector.

Figure 1B:
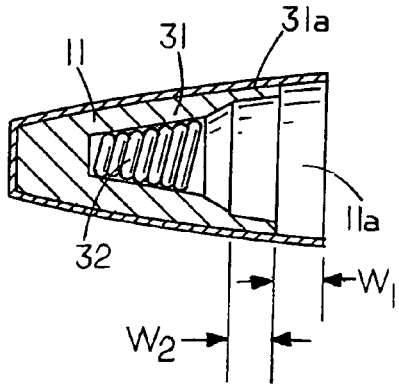
FIG. 1B is a sectional view taken along lines 1B-1B of FIG. 1.
Figure 1A:
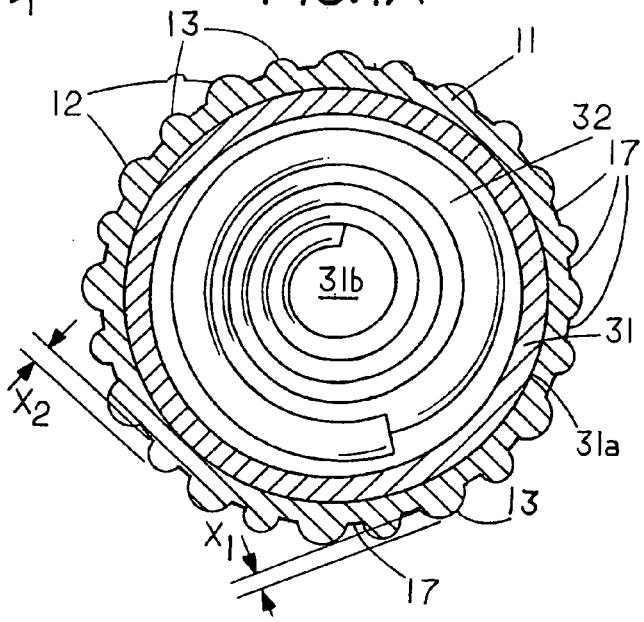
FIG. 1A is a sectional view taken along lines 2-2 of FIG. 1.

FIG. 1A shows an open-end rigid but non-brittle shell 31 secured to the spiral coil 32 with the rigid shell 31 having an outer surface 31*a* and a closed end 31*b*. The resilient cover 11 extends over an exterior surface of rigid shell 31 with the resilient cover 11 including a set of convex shaped resilient ribs 12 and 13 extending in a longitudinal or axial direction along the cover with the ribs circumferentially positioned around an exterior surface of the resilient cover 11 to form a valley 17 between adjacent ribs. The radial distance from the valley to an apex of an adjacent resilient rib is such that a radial compressive force on the adjacent resilient rib enables the epidermis layer on a users thumb and finger to radially engage both the valley 17 and the adjacent resilient ribs 12 and 13 with reduced or without epidermal trauma as the user applies radial compressive pressure thereto. As shown in FIG. 1 the set of uniform resilient ribs 12 and 13 comprise the sole radial projections from the twist-on wire connector which contributes to a user being to comfortably rotate the twist-on wire connector into a wire engaging condition while inhibiting or preventing epidermal trauma although additional projections may be used.

FIG. 1A shows a cross sectional view of twist-on wire connector 10 taken along lines 2-2 of FIG. 1 revealing the spiral wire engaging coil 32 and the rigid, non brittle shell 31 that supports the spiral wire engaging coil 32. Extending around the exterior of rigid shell 31 is the resilient cover 11 having a group of low profile convex ribs 12 and a group of low profile convex ribs 13 with a valley 17 located therebetween. FIG. 1A shows the low profile ribs 13 extend a radial distance x, from the valley 17 and the low profile ribs 12 extending a radial distance $x_2$ from the valley 17. While the radial distance x, may vary with the axial position along the exterior surface of the wire connector 10 the maxim radial distance x, is such that when the epidermal layer of the users thumb and the epidermal layer of the users fingers compressively deform the ribs 12 or 13 the epidermal layer of the users thumb and fingers can engage and obtain radial support from the valley 17 of resilient cover 11. To minimize epidermal trauma the radial height $x_1$ and $x_2$ of the resilient ribs may be maintained ⅛ of an inch or less and preferably 1/16 of an inch or less. In general the greater compressibility of the resilient cover the larger the radial height may be without inducing epidermal trauma.

The combined radial support provided by the radially deformable ribs 12 and 13 and the valley 17 inhibits or prevents epidermal trauma to the users thumb and fingers since epidermal contact with the connector extends over an area defined by a circumferential arc of engagement, which is designated as $S_1$ in FIG. 1. That is, with the invention described herein the normal harsh finger and thumb engagement with a rigid non brittle shell or a rigid rib on twist-on wire connector is minimized or eliminated by the resiliency of both the ribs and the valley while still allowing one to maintain a firm grasp of the connector through engagement of both the valley and the ribs on the connector. The firm grasp of the wire connector provided by the resilient ribs permits transmission of a wire securement torque to the exterior of the twist on wire connector without inducing epidermal trauma in the users fingers or thumb.

As shown in FIG. 1 and FIG. 1A the low profile resilient ribs have a convex shape including rounded corners that aid in the inhibiting or eliminating of epidermal trauma as the wire securement torque is applied to the exterior of the twist-on wire connector. In addition the radial distance $x_2$ of ribs 13 may be less than the radial distance $x_1$ of ribs 12 to further minimize epidermal trauma. That is, the proximity of ribs of different height next to each other further limits the epidermal trauma since the distance between the valley 17 and the top of rib 12 includes a rib 13 of intermediate height thereby minimizing abrupt changes in the surface of the twist-on wire connector.

FIG. 1B shows a cross sectional view taken along lines 1B-1B of FIG. 1 revealing the outer cover 11 extending over the inner rigid non brittle shell 31 having an annular flexing region identified by 31*a* and width $W_2$ with the flexing due to the cantilevered support and the relative thickness of the rigid material. That is a characteristic of a rigid but non-brittle materials is that when the material is thick or massive the material remains in a rigid state; however, when the thickness of material is reduced or the material is less massive the material can become flexible and yield. Rigid non-brittle materials can be found in metals as well as polymer plastics. In the present application an electrical insulated polymer plastic is well suited since it provides the necessary physical characteristics as well as the necessary electrical properties.

Figure 5:
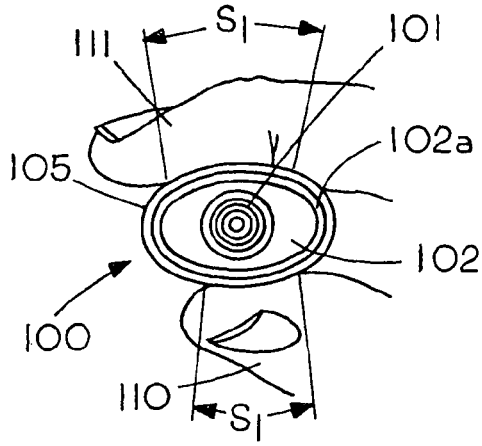
FIG. 5 shows the finger grasping motion on comfort grip and feel twist-on wire connector that is deformed into an oval shape by finger pressure.

The yieldable feature of thinner materials is illustrated in FIG. 5 where the thickness of the rigid non-brittle material has been reduced in the annular end portion of the connector to allow the annular end portion of the connector to deform to an oval shape as illustrated in FIG. 5. FIG. 1B shows the flexible skirt 11*a* of width $W_1$, which is unsupported, is identified by numeral 11*a*. Proximate flexible skirt 11*a* is yieldable flexing region 31*a* which has a width $W_2$. It is this region 31*a*, which is made from non-brittle material, that may yield in response to finger pressure on the connector and provide further resilient support for the users thumb and fingers.

Figure 2:
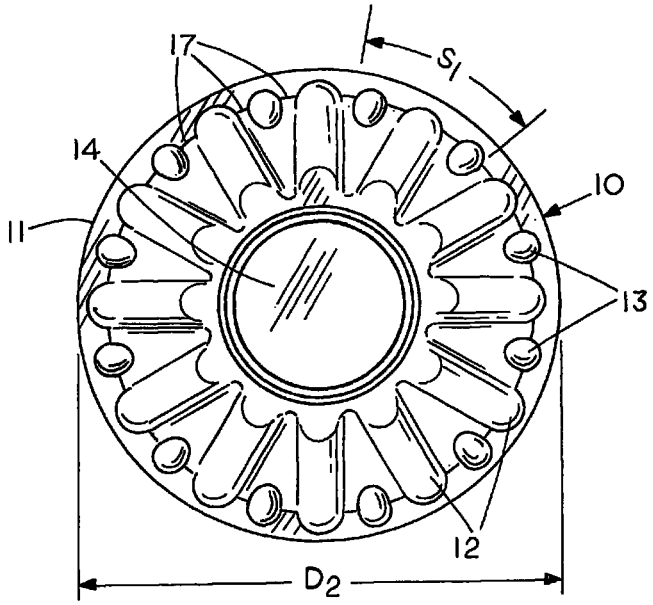
FIG. 2 is a top view of the comfort grip and feel twist-on wire connector of FIG. 1.

FIG. 2 shows a top view of the epidermal friendly twist-on wire connector 10 having a closed end 14 with a one-piece resilient cover 11 comprising a layer of resilient material which includes the first set of elongated ribs 12 circumferentially positioned and extending lengthwise or axially away from the open end of the twist-on wire connector and toward the closed end. The ribs are positioned on the outer exterior surface so the users fingers and thumb can grasp the connector therebetween in order apply a wire securement torque to the twist-on wire. While the twist-on wire connecters herein are shown with resilient material covering the entire outer surface the end surface of the connector, which is perpendicular to the axis of rotation of the connector surface areas may be left free of resilient material without departing from the spirit and scope of the invention. The set of resilient elongated ribs 12 and 13 together with the valley 17 therebetween coact to form a set of low profile convex radial protrusions that enable a user to more readily grasp and rotate the twist-on wire connector 10 without the fingers slipping on the surface of the cushion cover 11. The external features of the twist-on wire connector 10 as described herein not only provide a comfortable grip and feel to the user but they also inhibit or prevent epidermal trauma to the users fingers and thumb during applications of twist-on wire connectors.

FIG. 2 shows twist on wire connector 10 of diameter $D_2$ with a circumferential arcuate portion of the connector identified by $S_1$. The arc $S_1$ identifies the minimum circumferential length that the epidermal layer conforms to when a user grasps the twist-on wire connector between the users thumb and fingers.

Figure 3:
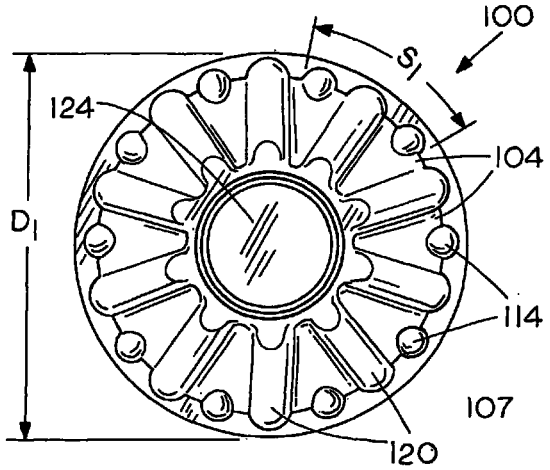
FIG. 3 is a top view of the comfort grip and feel twist-on wire connector of different size than the comfort grip and feel twist-on wire connector of FIG. 1.

FIG. 3 shows a similar twist-on wire connector 100 having a diameter $D_1$, which is smaller than diameter $D_2$ of connector 10. Connector 100 also includes a set of elongated resilient ribs 120 with a set of intermediate low profile resilient convex ribs 114 interspersed there between with a valley 104 with the bottom of valley 104 comprising a resilient material. An inspection of twist on wire connector 10 reveals that there are 12 elongated resilient ribs circumferentially spaced around the circumference of the connector and a similar inspection of twist-on wire connector 100 reveals that there are ten elongated ribs circumferentially spaced around the circumference of the connector 100. Each of the ribs of connector 100 and connector 10 are characterized by having a convex shape with smoothly contoured or rounded edges to limit epidermal trauma when a users fingers or thumb engages the ribs on the wire connector. On each of the connectors the circumferential arcuate portion of the connector is identified by $S_1$ where the arc $S_1$ identifies the minimum circumferential length that the epidermal layer conforms to when a user grasps the twist-on wire connector 10 between the thumb and fingers. In each connector the user will typically engage at least three ribs. A feature of the invention is that the circumferential rib density remains approximately the same for different size wire connectors to ensure that the epidermal contact region includes a plurality and preferably three or more ribs. Thus for example in a family of epidermal finger friendly twist-on wire connectors such as connector 10 and 100 the circumferential density of resilient ribs located around an exterior of any the family of epidermal friendly twist on wire connector is independent of a diamater of the twist-on wire connectors.

A further benefit of interspersing of a first group of resilient ribs between a second group of resilient ribs in a uniform relationship is that it enables the twist-on connector to be rolled between a users finger and thumb to retain the same touch and feel while maintaining the same rotational torque on the twist-on wire connector since the circumferential gripping surface is free of protrusions that may cause epidermal trauma. As can be seen in the Figures the resilient ribs 12 and 13 while tapering from a base toward the closed end of the twist-on wire connector generally have a uniform radial profile with rounded edges that provides a comfortable grip or feel to the twist-on wire connector.

Figure 4:
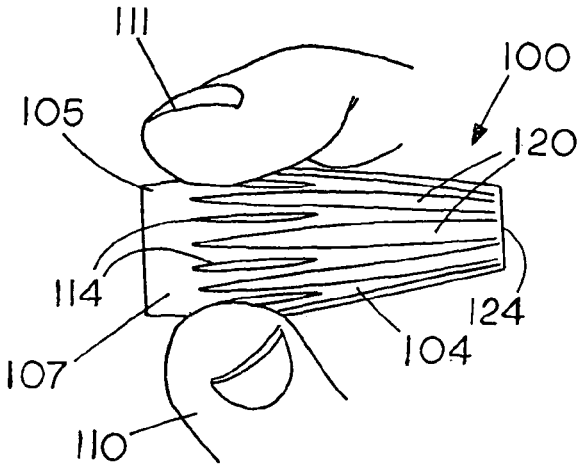
FIG. 4 illustrates the finger grasping motion on a comfort grip and feel twist-on wire connector.

FIG. 4 shows a users thumb 110 and finger 111 grasping an exterior surface of a resilient cover 105 of twist-on wire connector 100. Wire connector 100 includes a first set of convex elongated integral ribs 120 and a second set of convex elongated integral ribs 114. Resilient cover 105 includes a valley 104 proximate the ribs. Similarly, FIG. 5 shows an end view of thumb 110 and finger 111 grasping connector 100. The end view in FIG. 5 illustrates a radial deforming of the end of the rigid shell 102*a* in to an oval shape in response to radial pressure. That is the outer end of rigid non-brittle radial shell 102*a* is sufficiently thin so that a compressive force can deform the connector to an oval shape thus further protecting the uses fingers and thumb from epidermal trauma since not only does the resilient cover yield in response to pressure a lower portion of the entire twist-on wire connector also yields thus distributing the forces in a manner that inhibits or prevents epidermal trauma.

FIG. 4 and FIG. 5 also illustrate how the wire securement torque can be applied to the connector 100 to roll the connector between the finger 111 and thumb 110 to bring electrical wires into engagement with the spiral coil 101 therein. The step of rolling the wire connector 100 between the users finger and the users thumb during the rotating of the resilient cover allows one to sequentially maintain at least three resilient ribs in contact with the users finger and thus inhibit or prevent epidermal trauma.

Figure 6:
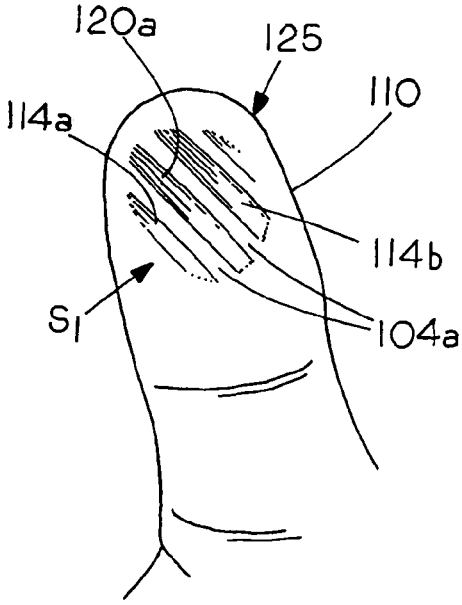
FIG. 6 outlines the typical epidermis contact area with a comfort grip and feel twist-on wire connector of FIG. 3.

To illustrate the relationship of the epidermal layer on the users thumb and fingers to the external features of the connector 100 reference should be made to FIG. 6 which shows a thumb 110 with an epidermal imprint extending over an arc distance $S_1$ with the imprint caused by thumb engagement with the resilient ribs 114 and 120 and valley 104 of twist on wire connector 100. Note, the epidermal imprint includes a first elongated imprint 114*a* caused by resilient rib 114, a second elongated imprint 120*a* caused by resilient rib 120 and a third elongated imprint 114*b* caused by resilient rib 114. A lesser imprint 104*a* results from contact with valley 104.

Similarly, if thumb 110 were to engage the twist-on wire connector 10 a similar set of imprints would occur over an arc distance $S_1$. A common feature of the imprints is that although the number of ribs on the twist-on wire connector are different the contact region on the users finger or thumb as well as the rib imprints remains substantially the same. By having at least three ribs and the valley in contact with the users finger or thumb one can reduce trauma to the epidermal layer of the users fingers and thumb since the wire securement torque is distributed over three ribs and the valley therebetween. In addition the use of resilient ribs rather than rigid ribs further reduces the epidermal trauma as the ribs can compress in response to the user grasping force thereby lessening trauma to the epidermal layers of the thumb and fingers. By inclusion of resilient valleys between the ribs and limiting the height of the ribs such that radial finger and thumb compression of the ribs brings the epidermal layer of the users skin into pressure engagement with both the valleys and the ribs also creates a comfortable feel and grip to the twist-on wire connector that allows a user to combat finger fatigue resulting from applying wire securement torque. The compressive grip on the resilient ribs and the valley provides tangential resistance to finger and thumb slippage thereon without the need for wings on the wire connector although if desired wings may be added to the wire connector without detracting from the invention.

While a resilient soft cover on the exterior surface of the twist-on wire connector provides a radial finger cushion the use of low profile, convex radial protruding resilient ribs on the exterior surface of the twist-on wire connector allows one to provide a tangential force to rotate the twist-on wire connector about a set of electrical wires Accordingly, a feature of the invention is that the twist-on wire connectors have an exterior surface that provides a epidermal friendly grip while inhibiting or preventing epidermal trauma on the users fingers and thumb.

With twist-on wire connectors of different diameters one spaces the ribs such that the finger contact region engages at least three ribs. Thus for larger diameter twist-on wire connectors the spacing of the ribs will be the same as for smaller diameter to ensure that at least three ribs contact each of the users fingers and thumb when the twist-on wire connector is grasped. In addition the user of shorter ribs interspersed on the base of the wire connector ensures that at least three ribs will engage a users finger and thumb. As a user grasper toward the top of the twist-on wire connector the elongated ribs become closer together since they extend longitudinally along the surface. While preferably three ribs are desired it is envisioned that more or less ribs may be engaged without departing from the spirit and scope of the invention.

Thus a feature of the invention described herein is allow one to comfortably grasp and rotate a twist-on wire connector to apply a wire securement torque regardless of the size of the twist-on wire connector while at the same time inhibiting or preventing epidermal trauma to the users fingers and thumb.

A further feature of the invention herein is the relationship of the exterior surface of the twist-on wire connector to the epidermal layer of a user's finger and thumb. Briefly in application of pressure to the twist-on wire connector the wire connector is squeezed between a users index finger and thumb. The outer epidermis layer of skin engages the surface of the wire connector with the interior dermis layer and fatty tissue provide a cushion between the bones of the index finger and the bones of the user's thumb.

The invention can provide an epidermal contact area is that eliminates edges that may rupture or injure the epidermal layer if the user grasps the twist-on wire connector to apply a wire securement torque to the twist-on wire connector. In addition to provide for an epidermal friendly grip the ribs that are compressively engaged by a users fingers and are limited from protruding from the surface of the twist-on wire connector beyond the limits of the epidermal layer to yield or flex as the wire securement torque is applied on the exterior surface of the wire connector.

Although the examples described herein disclose resilient ribs it should be understood that the same effect can be obtained through the use of sets of elongated grooves or reliefs in the resilient cover.

It will be appreciate that the invention includes an epidermal friendly method of securing a twist-on wire connector since the surfaces of the wire are free of edges or ridges that may cause epidermal trauma. Applying a wire securement torque to a twist-on wire connector involves the steps of grasping the resilient cover in the ribbed region between an epidermal layer of a users finger and an epidermal layer of a users thumb, squeezing the resilient cover to compress a portion of the resilient ribs until the epidermal layer of the users finger and the epidermal layer of the users thumb are in engagement with both a valley and a top surface of the resilient ribs without causing epidermal trauma. One can then apply the wire securement torque to the resilient cover of the twist-on wire connector while maintaining the epidermal layer of the users thumb and the epidermal layer of the users finger in pressure contact with the resilient ribs and the valley.

During the squeezing process at least a portion of three resilient ribs on diagonal opposite sides of said twist-on wire connector may be engaged to allow the user to roll the wire connector between the users finger and the users thumb during the rotating of the resilient cover to thereby bring a set of wires into electrical contact with each other.

While the epidermal friendly twist-on wire connector described herein uses a resilient cover with resilient ribs to limit epidermal trauma as well as a deformable base on the twist on wire connector it is envisioned that one may use either or both to limit epidermal trauma during the securement of a wire connection therein. It is further envisioned that in some cases the cover containing the ribs may be integral to a normally hard or rigid non-brittle shell which may rendered flexible in part by forming a thin base there beneath.

The invention claimed is:

1. An epidermal friendly twist-on wire connector comprising:

a spiral coil;

an open-end rigid shell secured to the spiral coil, said rigid shell having an outer surface, a closed end, and a deformable annular band, said deformable annular band proximate an open end of the open-end rigid shell;

a resilient cover extending over the outer surface of said rigid shell with said resilient cover including a set of resilient ribs extending in a longitudinal direction along said cover with said set of resilient ribs circumferentially positioned around an exterior surface of the resilient cover to form a valley between a first rib of the set of resilient ribs and an adjacent rib of the set of resilient ribs whereby a radial distance from the valley to an apex of the adjacent resilient rib is such that a radial compressive force on the adjacent resilient rib enables a finger epidermis layer and a thumb epidermis layer to radially engage both the valley and the adjacent resilient rib to allow a user to apply a wire securement torque to the twist-on wire connector wherein the wire securement torque is insufficient to generate epidermal trauma as the user applies the wire securement torque thereto.

2. The epidermal friendly twist-on wire connector of claim 1 wherein the set of resilient ribs are integral to the resilient cover.

3. The epidermal friendly twist-on wire connector of claim 2 wherein the set of resilient ribs have a uniform radial profile.

4. The epidermal friendly twist-on wire connector of claim 3 wherein the set of resilient ribs includes a first group of resilient ribs interspersed between a second group of resilient ribs to enable the twist-on connector to be rolled between a user's finger and thumb while maintaining the wire securement torque on the twist-on wire connector.

5. The epidermal friendly twist-on wire connector of claim 4 wherein the first rib of the set of resilient ribs and the adjacent rib of the set of resilient ribs are equally spaced from each other and an arc of finger engagement with the resilient cover extends to at least three adjacent resilient ribs in the set of resilient ribs.

6. The epidermal friendly twist-on wire connector of claim 5 wherein each of the resilient ribs in the set of resilient ribs includes rounded corners and a radial height of less than ⅛ of an inch.

7. The epidermal friendly twist-on wire connector of claim 6 wherein a circumferential density of the set of resilient ribs located around an exterior surface of a family of different sized epidermal friendly twist on wire connector is independent of a diameter of the twist-on wire connectors in the family of different sized epidermal friendly twist-on wire connectors.

8. The epidermal friendly twist-on wire connector of claim 7 wherein the resilient cover extends in an unsupported condition beyond the open end of the open-end rigid shell to form a one piece integral skirt.

9. The epidermal friendly twist-on wire connector of claim 8 wherein the deformable annular band is sufficiently thin so as to flex in response to radial finger pressure.

10. The epidermal friendly twist-on wire connector of claim 9 wherein the set of resilient ribs comprises elongated ribs of unequal length with said set of resilient ribs comprising the sole radial projections from the twist-on wire connector.

11. An epidermal friendly twist-on wire connector comprising:

a rigid shell having an annular open end, an outer surface and a closed end;

a spiral coil located within a hollow of the rigid shell;

a cover extending over the outer surface of said rigid shell; with said cover including a valley and a set of elongated ribs comprising a first group of resilient ribs and a second group of resilient ribs wherein the first group of resilient ribs is interspersed between the second group of resilient ribs and the first group of resilient ribs is longer than the second group of resilient ribs with said set of elongated ribs extending radially therefrom, said set of elongated ribs extending in a longitudinal direction along said cover with said set of elongated ribs circumferentially positioned so that an arc of finger engagement therewith includes the valley and at least three ribs of the set of elongated ribs whereby a radial distance from the valley to an apex of an adjacent resilient rib of the set of elongated ribs is such that a radial compressive force on the at least three ribs in the arc of finger engagement enables an epidermis layer of skin on a finger and a thumb of a user to engage both the valley and the at least three ribs as an exterior surface of the twist-on connector compressively yields during application of a wire securement torque thereto to thereby inhibit or prevent epidermal trauma.

12. The epidermal friendly twist-on wire connector claim 11 wherein the spacing of the set of elongated ribs decrease from the annular open end to the closed end of the wire connector.

13. The epidermal friendly twist-on wire connector of claim 11 wherein the set of elongated ribs are resilient and spaced sufficiently apart so that the epidermis layer of skin on the finger or the thumb of the user can deform into the valley between the at least three ribs of the set of elongated ribs without trauma to the epidermis layer of skin.

14. The epidermal friendly twist-on wire connector of claim 11 wherein the circumferential density of the set of elongated ribs is substantially the same for different diameter twist-on wire connectors in a family of epidermal friendly twist-on wire connectors.

15. The epidermal friendly twist-on wire connector of claim 11 wherein the arc of finger engagement includes a set of at least three ribs on an opposite diametrical side of the connector.

16. The epidermal friendly twist-on wire connector of claim 11 wherein the set of elongated ribs are resilient and integral to the cover.

* * * * *